United States Patent [19]

Isobe

[11] Patent Number: 4,619,389

[45] Date of Patent: Oct. 28, 1986

[54] PAPER TRACTOR

[75] Inventor: Minoru Isobe, Tokyo, Japan

[73] Assignee: Oki Electric Industry Co., Ltd., Tokyo, Japan

[21] Appl. No.: 729,349

[22] Filed: May 1, 1985

[30] Foreign Application Priority Data

May 2, 1984 [JP] Japan ..... 59-87836

[51] Int. Cl.[4] ..... B65H 20/22

[52] U.S. Cl. ..... 226/79; 226/82

[58] Field of Search ..... 266/52, 76, 78, 79, 266/82, 83, 84, 85

[56] References Cited

U.S. PATENT DOCUMENTS

| | | | |
|---|---|---|---|
| 3,448,906 | 6/1969 | Walsh et al. | 226/79 X |
| 3,534,684 | 10/1970 | Rupp | 226/76 X |
| 3,838,804 | 6/1974 | Bonafino | 226/76 |
| 4,358,039 | 11/1982 | Buzzell | 226/79 |
| 4,421,262 | 12/1983 | Chida et al. | 226/79 |

FOREIGN PATENT DOCUMENTS 2142989 8/1970 Fed. Rep. of Germany .

OTHER PUBLICATIONS

The Patent Office Japanese Covernment, p. 3 M 32, Kokai-No. 55-87585.

*Primary Examiner*—Donald Watkins

*Attorney, Agent, or Firm*—Wenderoth, Lind & Ponack

[57] ABSTRACT

A paper tractor feeds print paper along the outer peripheral surface of a platen with sprocket pins fitted in feed holes in the print paper. The paper tractor device which includes ring pin tractors each composed of a wheel having the sprocket pins on its outer periphery and a gear integral with the wheel. The ring pin tractors are slidable over the outer peripheral surface of the platen in intimate contact therewith. The ring pin tractors are rotated through the gears thereof in the same direction at the same speed as the platen. The paper tractor can feed print paper of various widths.

6 Claims, 6 Drawing Figures

PAPER TRACTOR

BACKGROUND OF THE INVENTION

The present invention relates to a paper tractor for feeding paper, especially fanfold paper, in a printer.

Prior sheet feeders in printers are constructed to feed various types of print paper such as individual sheets and continuous paper. One conventional sheet feeder for feeding continuous paper, particularly fanfold paper, having feed holes on both sides thereof, comprises a cylindrical platen for winding the paper partically therearound, a guide shape extending parallel to the platen, and a pair of pin tractors supported on the guide shaft. The pin tractors have a plurality of pins for fitting in the feed holes in the fanfold paper. The pins on the pin tractors are rotated when the guide shaft is rotated, thereby moving and feeding the paper. There are two types of paper feeding known in the art. The first paper feeding type is such that the paper is pulled by the pin tractors to move in a path below and then over the platen and through the pin tractors. According to the second paper feeding type, the paper is pushed by the pin tractors to move in the path through a pin tractors and then below and over the platen. Each of these paper feeding types can be employed for feeding paper of various widths since the pin tractors are movable parallel to the guide shaft.

However, the paper-pulling pin tractors have been disadvantageous in that the pin tractors and the guide shaft tend to interfere with the fanfold paper as it is set in place. The use of the pin tractors results in a complex printer which cannot be reduced in size.

The paper-pushing pin tractors also suffer from the above difficulties, and have additional problems in that the paper will not be fed accurately and printed images are liable to become distorted when a graphic pattern is printed in a dot printer.

Another known paper tractor has a cylindrical platen for winding paper partically therearound and a pair of pin wheels fixed to the opposite ends of the platen. The pin wheels have a plurality of pins for fitting in feed holes defined in the opposite sides of paper. Since the pin wheels rotate with the platen, the paper can be fed accurately to feed the paper line-by-line in alignment with the line position which is printed. This known paper tractor mechanism is simpler and smaller than the system having the pin tractors. However, because the pin wheels are spaced at a fixed interval, the width of the paper that can be used is limited.

Recent printers are required to be able to feed the paper accurately in forward and reverse directions for graphic and color printing operations, for example. There is a demand for a paper feeder capable of feeding print paper of different widths and of feeding the print paper highly accurately.

SUMMARY OF THE INVENTION

It is an object of the present invention to provide an improved paper tractor for use in a printer.

Another object of the present invention is to provide a paper tractor capable of feeding print paper of various widths.

Still another object of the present invention is to provide a paper tractor which can feed paper accurately and stably.

A still further object of the present invention is to provide a paper tractor which is simple in mechanism and small in size.

A paper tractor according to the present invention has ring-shaped wheels slidably mounted on the outer periphery of a platen in intimate contact therewith. Each of the wheels has integral sprocket pins and an integral gear, which serve as a ring pin tractor as a whole. The gear is driven by the rotation of such as a spline shaft extending parallel to the platen and the like. The paper tractor of the invention further include holders for sliding the ring pin tractors parallel to the platen and the spline shaft. Since the holders and the ring pin tractors are coupled together for movement over the outer periphery of the platen, the paper tractor can feed print paper of various widths. Inasmuch as the ring pin tractors rotate with the platen, the paper tractor is of a simple mechanism and a small size, and can feed with a higher degree of accuracy.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
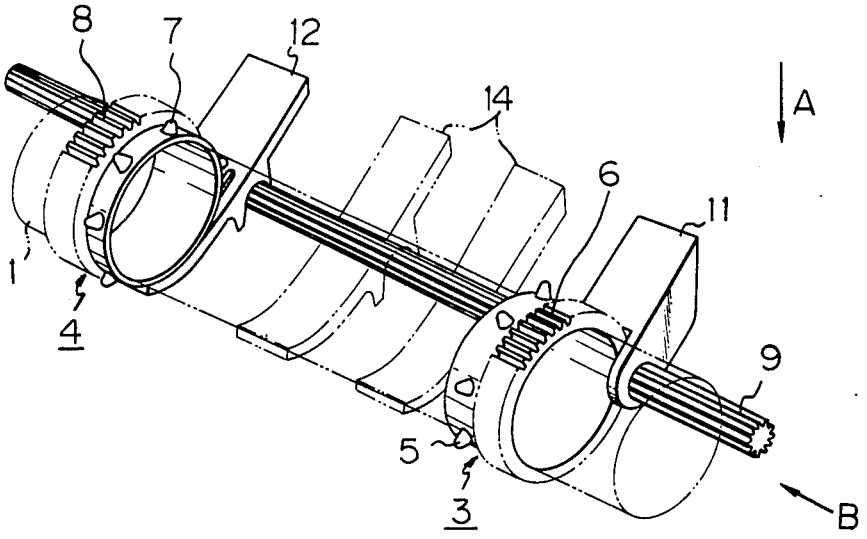
FIG. 1 is a perspective view of a paper tractor according to the present invention.
Figure 2:
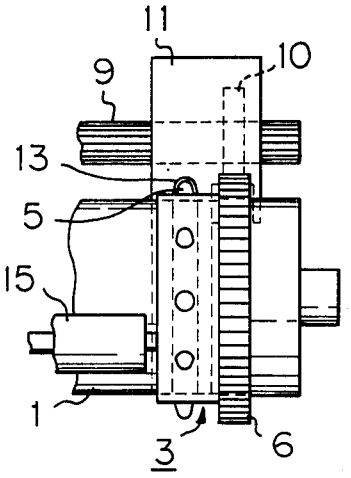
FIG. 2 is a fragmentary plan view of the paper tractor as seen in the direction of the arrow A in FIG. 1.
Figure 3:
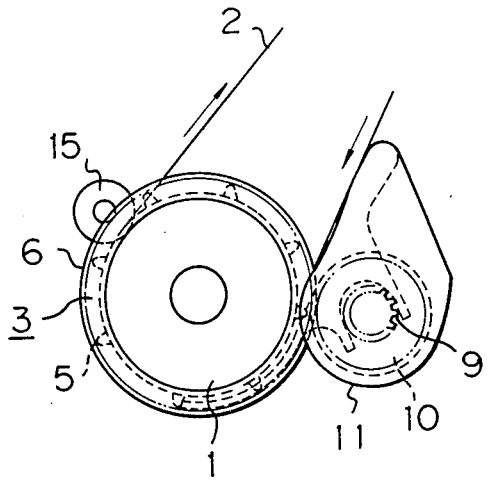
FIG. 3 is a side elevational view of the paper tractor as seen in the direction of the arrow B in FIG. 1.

As shown in FIGS. 1 through 5, a paper tractor according to the present invention includes a cylindrical platen 1 around which print paper is wound, and a pair of ring pin tractors 3, 4. The ring pin tractor 3 is composed of a ring-shaped wheel having a reduced wall thickness and slidable over the outer periphery of the platen 1 in intimate contact therewith, the ring pin tractor 3 having a plurality of angularly equally spaced sprocket pins 5 integrally mounted on the ring-shaped wheel. The ring pin tractor 3 also includes a gear 8 integral with the ring-shaped wheel and disposed on one axial side thereof. The ring pin tractor 4 is of the same construction having sprocket pins 7 and a gear 8.

Figure 4:
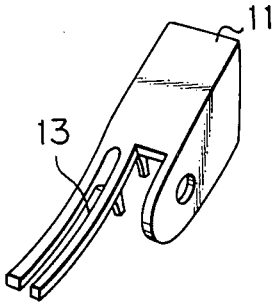
FIG. 4 is a perspective view of a holder as shown in FIGS. 2 and 3.

The ring pin tractors 3, 4 are driven by a drive shaft on the form of a gear-like spline shaft 9, extending parallel to the platen 1. A gear 10 is mounted on the spline shaft 9 and supported in a holder 11 as shown in FIG. 4. The ring pin tractor 3 is also held by the holder 11 for pressing the print paper 2 against the sprocket pins 5 of the ring pin tractor 3. Another gear (not shown) is supported on the spline shaft 9 by a holder 12 which holds the ring in tractor 4 for pressing the print paper 2 against the sprocket pin 7. The holder 12 has a shape which is the mirror image of the holder 11 illustrated in FIG. 4. The holder 11 shown in FIG. 4 has a clearance slot 13 through which the sprocket pins 3 pass.

The gear 10 is mounted on the spline shaft 9 in mesh therewith, and hence is slidable axially on the spline shaft 9 and rotatable therewith. The gear 10 is also held in mesh with the gear 6 of the ring pin tractor 3.

The non-illustrated gear associated with the ring pin tractor 4 is also mounted on the spline shaft 9 in mesh therewith, and hence is slidable axially on the spline shaft 9 and rotatable therewith. The gear is also held in mesh with the gear 8 of the ring pin tractor 4.

Figure 5:
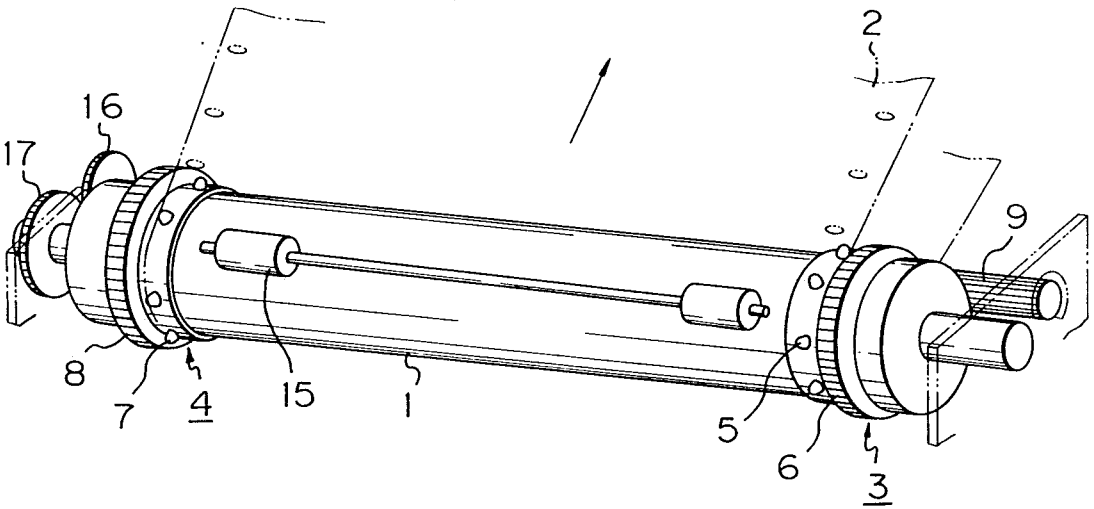
FIG. 5 is a perspective view of the manner of use of the paper tractor of the invention.

Paper guides 14 shown in FIG. 1 are of a configuration similar of that of the holders 11, 12. The print paper 2 is pressed against the platen 1 by rollers 15 shown in FIG. 5. As illustrated in FIG. 5, a gear 16 mounted on an end of the spline shaft 9 is held in mesh with a gear 17 mounted on an end of the platen 1.

Since the surface of the platen is necessarily smooth, the tractors 3, 4 would necessary be rotatable on the platen surface (but for the gears 16 and 17) in order that they be longitudially slidable as well. Thus, the gears 16 and 17 are needed to assure that the tractors 3, 4 rotate with the platen 1.

In assembly, the ring pin tractors 3, 4 are mounted on the platen 1 from its opposite ends, and the gears held in the holders 11, 12 are fitted over the spline shaft 9 in alignment with the ring pin tractors 3, 4, the gears being in mesh with the gears 6, 8 of the ring pin tractors 3, 4. The numbers of gear teeth of the gears 16, 17, 10, 6, 8 are selected such that the ring pin tractors 3, 4 will rotate exactly with the platen 1.

The portions of the ring pin tractors 3, 4 which have the sprocket pins 5, 7 are required to be of a reduced thickness, preferably 0.2 mm or smaller. As these thin portions are reinforced by the gears 6, 8, the thin portions will not cause any trouble in the operation of the ring pin tractors 3, 4.

Operation of the paper tractor of the invention is as follows:

The spline shaft 9 is rotated by a power source, not shown. The gears on the spline shaft 9 are also rotated to cause the gears 6, 8 to rotate the ring pin tractors 3, 4. At the same time, the gear 16 causes the gear 17 to rotate the platen 1. The ring pin tractors 3, 4 and the platen 1 rotate in the same direction at the same speed.

The print paper 2 as conveyed by a means (not shown) is supported by the holders 11, 12 and the paper guides 14 and inserted below the platen 1 between the ring pin tractors 3, 4.

The ring pin tractors 3, 4 as they rotate have their sprocket pins 5, 7 successively fitted into feed holes in the opposite sides of the print paper 2 to deliver the same from the position beneath the platen 1 through a position in front of the platen 1 in an upward direction. Simultaneously, the platen 1 is rotated as described above. With the print paper 2 thus delivered, it can be fed along stably and provide a good paper surface to be printed.

The ring pin tractors 3, 4 can be adjusted for feeding print paper 2 of a different width.

The ring pin tractor 3, the gear 10, and the holder 11 are interconnected so that the ring pin tractor 3 will slide axially along the platen 1 and the gear 10 and the holder 11 will slide axially along the spline shaft 9 over substantially the entire length of the platen (except as blocked by the paper guides 14 as illustrated in FIG. 1). The other ring pin tractor 4, the associated gear, and the holder 12 can also move in the same manner. The gears 6, 8 of the ring pin tractors 3, 4 can be manually held and the ring pin tractors 3, 4 can be moved toward or away from each other for a desired distance matching the width of the print paper 2 used. Then, the holders 11, 12 which hold the ring pin tractors 3, 4, respectively, are locked by a lock mechanism (not shown).

Figure 6:
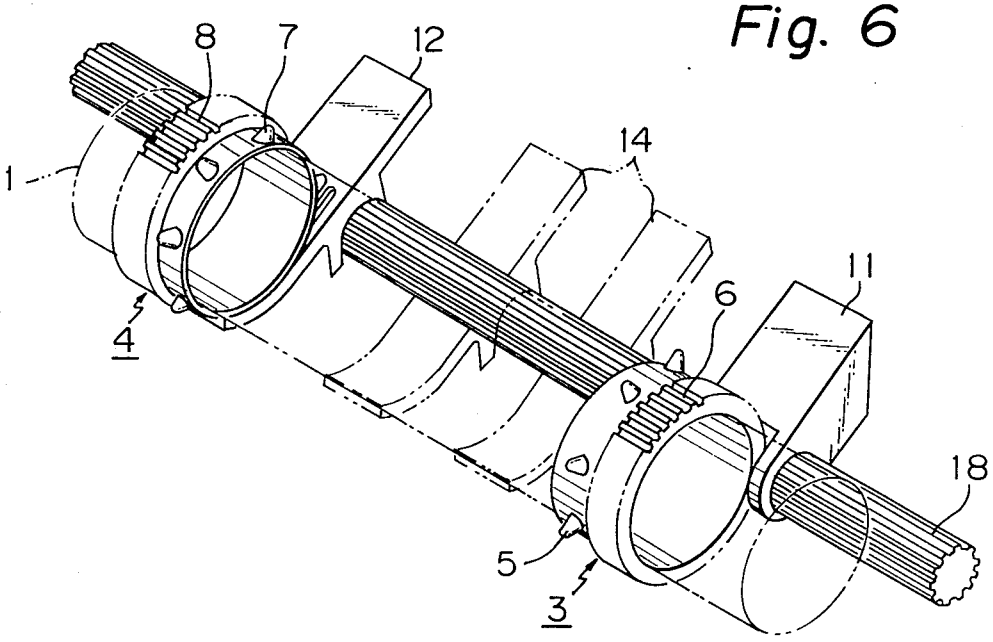
FIG. 6 is a perspective view of the paper tractor according to a second embodiment of the present invention.

FIG. 6 shows a second embodiment.

In that embodiment, the spline shaft 18 may comprise a gear meshing directly with the gears 6, 8 of the ring pin tractors 3, 4, without the use of the intermediary gears 10. The gear ratios between the gears 6, 8, the spline shaft 18, and the gears 16, 17 are selected so that the ring pin tractors 3, 4 and the platen 1 will rotate at the same angular speed.

Although certain preferred embodiments have been shown and described, it should be understood that many changes and modifications may be made therein without departing from the scope of the appended claims.

What is claimed is:

1. A paper tractor device for a printer, for feeding continuous print paper having feed holes on opposite sides thereof, comprising:

(a) a longitudinally extending cylindrical platen, rotatable for winding the print paper therearound;

(b) a pair of ring pin tractors each composed of a ring-shaped wheel slidably mounted on the outer periphery of said platen so as to be longitudinally movable thereon, and having a plurality of sprocket pins engageable in the feed holes in the print paper, each of said ring pin tractors including a tractor gear integral with said ring-shaped wheel;

(c) drive means for rotating said platen, and rotating said ring pin tractors through said tractor gears in the same direction at the same speed as said platen; and a pair of holders holding said ring pin tractors, slidably mounted on said drive means and coupled to said ring pin tractors for longitudinal movement with said ring pin tractors.

2. A paper tractor device according to claim 1, wherein said drive means comprises a spline shaft extending parallel to said platen, and a pair of drive gears axially movably mounted on said spline shaft and held in mesh with said tractor gears of said ring pin tractors.

3. A paper tractor device according to claim 1, wherein said drive means comprises a spline shaft extending parallel to said platen and comprising a gear held in mesh with said gears of said ring pin tractors.

4. A paper tractor device according to claim 1, wherein said ring pin tractors are longitudinally slidably movable over substantially the entire length of said platen.

5. A paper tractor device as in claim 1, wherein said platen has platen gears fixed to opposed ends thereof, said drive means including a rotatable longitudinally extending drive shaft, first drive gears fixed on said drive shaft in mesh with said platen gears, and second drive gears fixed on said drive shaft in mesh with said platen gears, such that said platen and said tractors are rotated together with respective rotations of said first and second gears on said drive shaft.

6. A paper tractor device as in claim 2, wherein said drive gears are supported in said holders for longitudinal movement therewith.

* * * * *